US008850713B2

(12) United States Patent
Nakamura et al.

(10) Patent No.: US 8,850,713 B2
(45) Date of Patent: Oct. 7, 2014

(54) HAND DRYING DEVICE

(75) Inventors: Jun Nakamura, Tokyo (JP); Takaki Kobayashi, Tokyo (JP); Tsukasa Sakane, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 174 days.

(21) Appl. No.: 13/698,532

(22) PCT Filed: Jul. 6, 2010

(86) PCT No.: PCT/JP2010/061459

§ 371 (c)(1),
(2), (4) Date: Nov. 16, 2012

(87) PCT Pub. No.: WO2012/004856

PCT Pub. Date: Jan. 12, 2012

(65) Prior Publication Data

US 2013/0055588 A1 Mar. 7, 2013

(51) Int. Cl.
*F26B 21/00* (2006.01)
*A47K 10/48* (2006.01)

(52) U.S. Cl.
CPC ..... *A47K 10/48* (2013.01)
USPC ..... 34/90; 2/168; D28/54.1; 392/384; 132/73

(58) Field of Classification Search
USPC ..... 34/90, 103, 104, 565, 202, 218; 2/167, 2/168; 4/168; D28/12, 54.1, 58; 392/381, 392/380, 384; 132/73, 200, 285
See application file for complete search history.

(56) References Cited

U.S. PATENT DOCUMENTS 3,094,704 A * 6/1963 Abildgaard ..... 2/167
4,692,951 A * 9/1987 Taki et al. ..... 4/664
5,459,944 A * 10/1995 Tatsutani et al. ..... 34/202
6,038,786 A * 3/2000 Aisenberg et al. ..... 34/267
D428,204 S * 7/2000 Elliott ..... D28/54.1

(Continued)

FOREIGN PATENT DOCUMENTS

EP 2591710 * 5/2013
JP 4-136195 U 12/1992

(Continued)

OTHER PUBLICATIONS

Korean Office Action (Notification of Reason for Refusal) dated Feb. 25, 2014, in corresponding Korean Application No. 10-2012-7031965 and an English translation thereof. (9 pgs).

(Continued)

*Primary Examiner* — Steve M Gravini
(74) *Attorney, Agent, or Firm* — Buchanan Ingersoll & Rooney PC

(57) ABSTRACT

A hand drying device includes: a drying chamber; a nozzle; a supply unit; a hand detection sensor; a control unit; and an illuminating unit. The drying chamber includes: an opening; a first inner wall surface; and a second inner wall surface facing the first inner wall surface. A hand is inserted from the opening into a space between the first inner wall surface and the second inner wall surface. The nozzle is arranged on the first inner wall surface and is configured to blow an air stream toward the second inner wall surface. A center axis of the nozzle and an optical axis of the illuminating unit intersect with each other at a proper position in the drying chamber where a hand is supposed to be inserted.

16 Claims, 7 Drawing Sheets

(56) References Cited

U.S. PATENT DOCUMENTS

| | | | | |
|---|---|---|---|---|
| 6,286,517 | B1 * | 9/2001 | Weber et al. | 132/73 |
| 7,437,833 | B2 * | 10/2008 | Sato et al. | 34/90 |
| 7,596,883 | B2 * | 10/2009 | Kameishi | 34/90 |
| 7,614,160 | B2 * | 11/2009 | Kameishi et al. | 34/90 |
| 7,657,162 | B2 * | 2/2010 | Itoigawa et al. | 392/384 |
| 7,774,953 | B1 * | 8/2010 | Duran | 34/77 |
| 7,971,368 | B2 * | 7/2011 | Fukaya et al. | 34/77 |
| 8,155,508 | B2 * | 4/2012 | Caine et al. | 392/380 |
| 8,201,344 | B2 * | 6/2012 | Sawabe et al. | 34/95 |
| 8,341,853 | B2 * | 1/2013 | French et al. | 34/90 |
| 8,347,521 | B2 * | 1/2013 | Churchill et al. | 34/82 |
| 8,347,522 | B2 * | 1/2013 | Dyson et al. | 34/90 |
| 8,490,291 | B2 * | 7/2013 | Churchill et al. | 34/90 |
| 2008/0256825 | A1 | 10/2008 | Hsu | |
| 2013/0055588 | A1 * | 3/2013 | Nakamura et al. | 34/565 |
| 2013/0086741 | A1 * | 4/2013 | Bayley et al. | 4/623 |

FOREIGN PATENT DOCUMENTS

| | | | | | |
|---|---|---|---|---|---|
| JP | 5-55988 | U | | 7/1993 | |
| JP | 6-062981 | A | | 3/1994 | |
| JP | 11178744 | A | * | 7/1999 | A47K 10/48 |
| JP | 2002-345682 | A | | 12/2002 | |
| JP | 2006-204738 | A | | 8/2006 | |
| JP | 2007-082904 | A | | 4/2007 | |
| WO | WO 2012004856 | | * | 1/2012 | |

OTHER PUBLICATIONS

International Search Report (PCT/ISA/210) issued on Aug. 10, 2010, by the Japanese Patent Office as the International Searching Authority for International Application No. PCT/JP2010/061459.

Written Opinion (PCT/ISA/237) issued on Aug. 10, 2010, by the Japanese Patent Office as the International Searching Authority for International Application No. PCT/JP2010/061459.

* cited by examiner

HAND DRYING DEVICE

FIELD

The present invention relates to a hand drying device.

BACKGROUND

As a hand drying device for drying a wet hand after washing, an apparatus has been known with which a user inserts a hand into a drying chamber surrounded by a wall having a vertical cross section formed substantially in a U-shape or a C-shape and blows a water droplet off of the hand by a high-pressure air stream to dry the hand. In such a hand drying device, as the inside of the drying chamber is not sufficiently bright with light (illumination light) from ambient light or the like in a space where the hand drying device is installed due to the shape of the wall of the drying chamber, the drying chamber is dark so that the user feels uncomfortable when inserting the hand into the drying chamber.

Patent Literature 1 describes a hand drying device that includes a lighting unit for lighting up a bottom portion of a drying chamber. Specifically, this hand drying device turns the lighting unit bright when a hand detecting signal is output from a sensor to brightly light up the bottom portion of the drying chamber, and dims the lighting unit when the hand detecting signal is not output from the sensor to dimly light up the bottom portion of the drying chamber. With this configuration, the hand drying device described in Patent Literature 1 can dispel the discomfort of a user when inserting a hand into the drying chamber while illuminating the drying chamber with lower power consumption as compared to a case where the illuminating unit is constantly turned bright on.

Patent Literature 2 describes a hand drying device that includes a light source in a nozzle. According to Patent Literature 2, as an optical path of illumination light from the light source matches a flow path of an air blown from the nozzle, it is possible to expose a wet hand to the air blown from the nozzle effectively by simply exposing a wet hand to the illumination light.

CITATION LIST

Patent Literatures

Patent Literature 1: Japanese Patent Application Laid-open No. 2006-204738

Patent Literature 2: Japanese Patent Application Laid-open No. 2007-82904

SUMMARY

Technical Problem

In a hand drying device, it is desired to place a hand in a potential core area (an area in which the speed of a high-pressure air stream at an outlet of a nozzle does not attenuate) in order to blow water droplet off of the hand with the high-pressure air stream efficiently. However, if a hand is placed too close to the nozzle, the hand is likely to touch an inner wall surface of the drying chamber so that the hand tends to become unsanitary. In addition, in a hand drying device of a type that blows air simultaneously from nozzles arranged on both sides of a back side of the hand and a palm side of the hand, it is likely to become difficult to realize a proper position for inserting the hand between the nozzle on the back side of the hand and the nozzle on the palm side of the hand, causing a difficulty in drying the back side of the hand and the palm side of the hand in a well balanced manner.

In the hand drying devices described in Patent Literatures 1 and 2, it is difficult to realize a proper position where a hand is supposed to be inserted in a processing chamber or a processing space (a drying chamber).

The present invention has been made in view of the above problems, and an object of the present invention is to obtain a hand drying device that enables a user to place a hand at a proper position in a drying chamber with ease.

Solution to Problem

To solve the above described problems and achieve the object, according to an aspect of the present invention a hand drying device includes: a drying chamber that includes an opening, a first inner wall surface, and a second inner wall surface facing the first inner wall surface, where a hand is inserted from the opening into a space between the first inner wall surface and the second inner wall surface; a nozzle that is arranged on the first inner wall surface and is configured to blow an air stream toward the second inner wall surface; a supply unit that supplies an air stream to the nozzle; a hand detection sensor that detects insertion of a hand into the drying chamber; a control unit that operates the supply unit when insertion of a hand is detected by the hand detection sensor and stops operating the supply unit when insertion of a hand is not detected by the hand detection sensor; and an illuminating unit that is arranged at a position on the first inner wall surface shifted from the nozzle in a direction along the first inner wall surface and is configured to emit light toward the second inner wall surface, and a center axis of the nozzle and an optical axis of the illuminating unit intersect with each other at a proper position in the drying chamber where a hand is supposed to be inserted.

Advantageous Effects of Invention

According to the present invention, in a drying chamber, by adjusting a position where a hand is exposed to an air stream from a nozzle and a position of an image of light from an illuminating unit on the hand to match each other, a user can place the hand in a proper position in the drying chamber. That is, it is possible to place a hand at a proper position in the drying chamber with ease.

DESCRIPTION OF EMBODIMENTS

Exemplary embodiments of a hand drying device according to the present invention will be explained below in detail with reference to the accompanying drawings. The present invention is not limited to the embodiments.

First Embodiment

Figure 1:
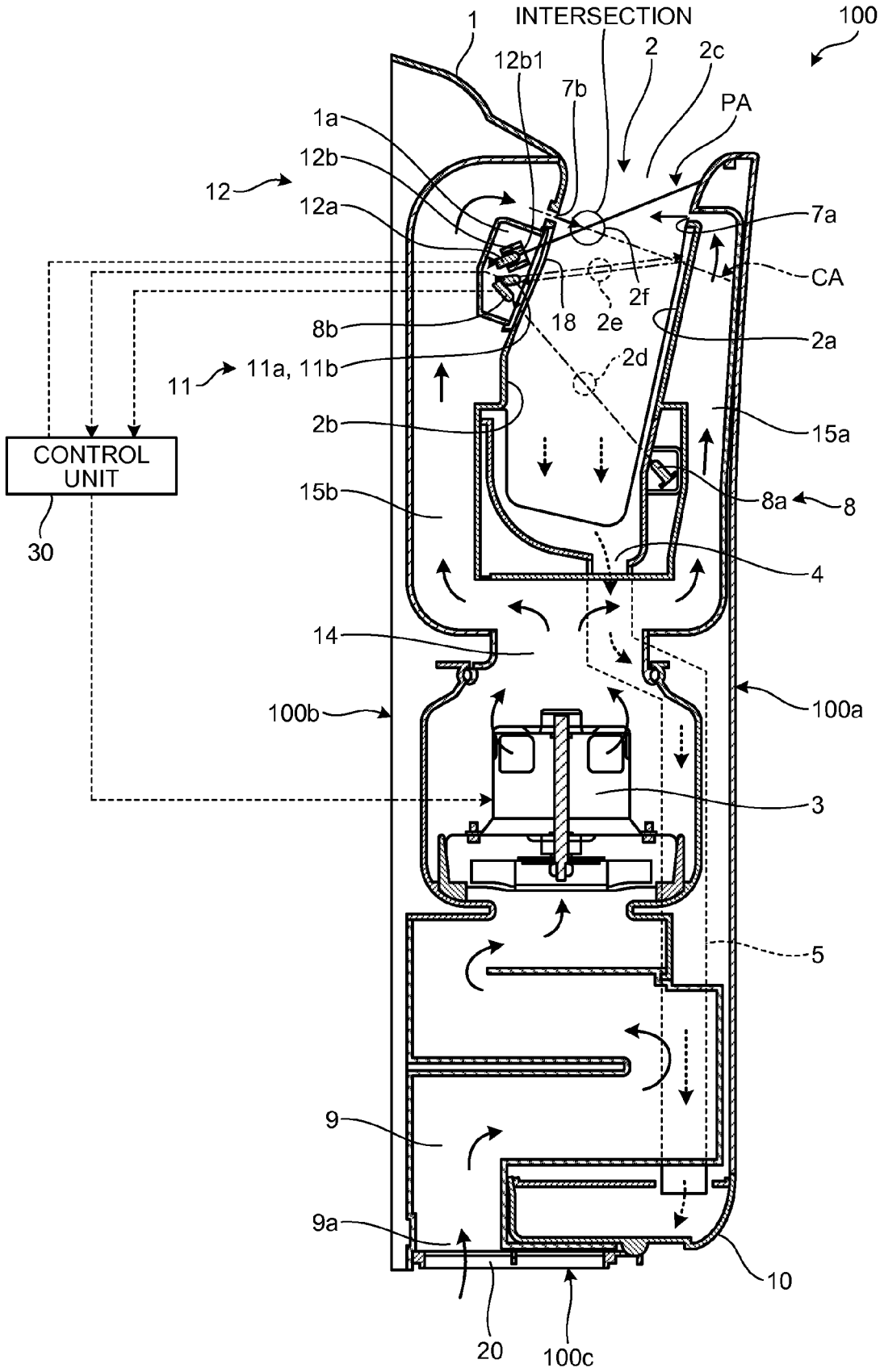
FIG. 1 depicts a configuration of a hand drying device according to a first embodiment.

A hand drying device 100 according to a first embodiment is explained with reference to FIG. 1. FIG. 1 is a cross-sectional view of the hand drying device 100 according to the first embodiment cut in a direction parallel to the vertical direction and perpendicular to a front surface 100*a*. In FIG. 1, an arrow of solid line indicates a flow of an air stream, an arrow of dotted line indicates a flow of a water droplet removed from a hand, an arrow of dashed-dotted line indicates infrared light from a hand detection sensor, and an arrow of wavy line indicates an optical path.

The hand drying device 100 includes a main unit box 1, a drying chamber 2, a blower (supply unit) 3, nozzles 7*a* and 7*b*, a hand detection sensor 8, a hand detection sensor (second hand detection sensor) 11, an illuminating unit 12, a transparent cover 18, and a control unit 30.

The main unit box 1 forms an external body of the hand drying device 100, forming the front surface 100*a*, a rear surface 100*b*, and a bottom surface 100*c* of the hand drying device 100. The front surface 100*a* is a side a user faces when using the hand drying device 100. The rear surface 100*b* is a side opposite to the front surface 100*a*. The bottom surface 100*c* is a side abutting the front surface 100*a* and the rear surface 100*b*, which is opposite to a side from which the user inserts a hand into the hand drying device 100.

The drying chamber 2 is arranged on an upper portion of the inner side of the main unit box 1. The drying chamber 2 is configured such that the user can freely insert the hand into and pull out the hand from. The drying chamber 2 is a space formed by a portion of a U-shaped wall in the main unit box 1 and is extended in an inclined manner such that the space approaches the rear surface 100*b* of the hand drying device 100 as it approaches the bottom surface 100*c*.

Specifically, the drying chamber 2 includes an opening 2*c*, an inner wall surface (first inner wall surface) 2*b*, and an inner wall surface (second inner wall surface) 2*a*. The opening 2*c* is an opening for inserting the hand into the drying chamber 2. The inner wall surface 2*b* is an inner wall surface on a side closer to the rear surface 100*b* in the drying chamber 2 and facing the inner wall surface 2*a*. The inner wall surface 2*a* is an inner wall surface on a side closer to the front surface 100*a* in the drying chamber 2 and facing the inner wall surface 2*b*. In the drying chamber 2, the hand is inserted between the inner wall surface 2*b* and the inner wall surface 2*a* from the opening 2*c*.

A drain port 4 is formed on a bottom portion of the drying chamber 2, and a drain pipe 5 is connected to the drain port 4. The drain pipe 5 is extended to a drain container 10 arranged on a bottom portion of the main unit box 1. The water droplet and the water removed from the hand are collectively referred to as "drain". A water-shedding coating of silicon based or fluorine based material or a hydrophilic coating of titanium oxide or the like is formed on the inner wall surfaces 2*a* and 2*b* that are opposing surfaces in the drying chamber 2, and the coating is impregnated with an antibacterial material, so that contamination of the inner wall surfaces 2*a* and 2*b* can be reduced and bacterial multiplication can be reduced at the same time.

The blower 3 is built-in at a lower part of the drying chamber 2 on the inner side of the main unit box 1. The blower 3 generates, for example, a high-pressure air stream from an air taken in via an air inlet duct 9, and supplies the high-pressure air stream to the nozzles 7*a* and 7*b* via air outlet ducts 15*a* and 15*b*. The air inlet duct 9 is extended downward in a meandering manner from the blower 3 arranged virtually in a center portion of the main unit box 1, passes behind the drain container 10, and is opened to the atmosphere. An air filter 20 is installed on an air inlet port 9*a*. An air outlet port 14 connected to the air inlet duct 9 is arranged on an upper portion of the blower 3, and is connected to the air outlet ducts 15*a* and 15*b*, so that the high-pressure air stream is blown from the nozzles 7*a* and 7*b*.

Each of the nozzles 7*a* and 7*b* blows the high-pressure air stream supplied from the blower 3. The nozzles 7*a* and 7*b* are arranged on the inner wall surfaces 2*a* and 2*b*, respectively, near the opening 2*c* of the drying chamber 2. That is, the nozzle 7*b* is arranged on the inner wall surface 2*b*, and blows the high-pressure air stream toward the inner wall surface 2*a*. The nozzle 7*a* is arranged on the inner wall surface 2*a*, and blows the high-pressure air stream toward the inner wall surface 2*b*. With this configuration, when the hand is inserted into the drying chamber 2, the nozzles 7*a* and 7*b* blow a wind to both sides of a back side of the hand and a palm side of the hand, so that the water droplet on the hand can be removed from the back side and the palm side of the hand without rubbing hands together, which are inserted into the drying chamber 2.

The hand detection sensor 8 includes a light emitting element (light emitting unit) 8*a* and a light receiving element (light receiving unit) 8*b*. The hand detection sensor 8 is, for example, a transmission type sensor, in which the light emitting element 8*a* is arranged on the side of the inner wall surface 2*a*, and the light receiving element 8*b* is arranged on the side of the inner wall surface 2*b*. The light receiving element 8*b* is arranged on the side of the inner wall surface 2*b* and the light emitting element 8*a* is arranged on the side of the inner wall surface 2*a* such that infrared light emitted from the light emitting element 8*a* passes a detecting position 2*d* in the drying chamber 2 and is received by the light receiving element 8*b*. With this configuration, the hand detection sensor 8 detects insertion of the hand at the detecting position 2*d* in the drying chamber 2 according to an amount of light received by the light receiving element 8*b*.

The hand detection sensor 11 includes a light emitting element (second light emitting unit) 11*a* and a light receiving element (second light receiving unit) 11*b*. The hand detection sensor 11 is, for example, a reflection type sensor, in which both the light emitting element 11*a* and the light receiving element 11*b* are arranged on the side of the inner wall surface 2*b*. Both the light emitting element 11*a* and the light receiving element 11*b* are arranged on the side of the inner wall surface 2*b* such that infrared light emitted from the light emitting element 11*a* passes a detecting position 2*e* in the drying chamber 2, is reflected at the inner wall surface 2*a* and returns to the light receiving element 11*b*, and is received by the light receiving element 11*b*. At this time, the detecting position 2*e* of the hand detection sensor 11 is closer to the opening 2*c* of the drying chamber 2 than the detecting position 2*d* of the hand detection sensor 8. With this configuration, the hand detection sensor 11 detects insertion of the hand at the detecting position 2*e* that is closer to the opening 2*c* than the detecting position 2*d* of the hand detection sensor 8 in the drying chamber 2.

The illuminating unit 12 is arranged at a position on the side of the inner wall surface 2*b* shifted from the nozzle 7*b* in a direction along the inner wall surface 2*b*, and emits light toward the inner wall surface 2*a*. Specifically, the illuminating unit 12 includes a light source 12*a* and a light shielding unit 12*b*. The light source 12*a* emits the light. The light source 12*a* includes an LED, for example. The light shielding unit 12*b* includes an aperture 12*b*1 for guiding the light from the light source 12*a* to a proper position 2*f* in the drying chamber 2 and shields an area around the aperture 12b1. The light shielding unit 12b is formed of a resin, for example. An opening shape of the aperture 12b1 of the light shielding unit 12b is a shape corresponding to an opening shape of the nozzle 7b, for example, an equivalent shape to the opening shape of the nozzle 7b.

As indicated by the wavy line in FIG. 1, a center line of the light emitted from the light source 12a (for example, an LED), that is, an optical axis of the illuminating unit 12 intersects with the inner wall surface 2a. With this configuration, the light emitted from the illuminating unit 12 is shielded by the inner wall surface 2a.

The transparent cover 18 forms the inner wall surface 2b together with the main unit box 1. That is, the main unit box 1 forms the inner wall surface 2a and a part of the inner wall surface 2b, and includes a recessed portion 1a recessed from the inner wall surface 2b on the side of the inner wall surface 2b. The transparent cover 18 covers the recessed portion 1a to form a rest part of the inner wall surface 2b. The light source 12a and the light shielding unit 12b of the illuminating unit 12, the light receiving element 8b of the hand detection sensor 8 (for example, a transmission type sensor), and the light emitting element 11a and the light receiving element 11b of the hand detection sensor 11 (for example, a reflection type sensor) are accommodated together in the recessed portion 1a covered by the transparent cover 18. The transparent cover 18 is formed of, for example, a transparent material such as a glass.

While the control unit 30 is schematically illustrated in FIG. 1, for example, the control unit 30 can be built-in in the main unit box 1 or may be provided on the outside of the main unit box 1. The control unit 30 receives a signal indicating whether insertion of the hand is detected at the detecting position 2d in the drying chamber 2 from the light receiving element 8b of the hand detection sensor 8. The control unit 30 receives a signal indicating whether the insertion of the hand is detected at the detecting position 2e in the drying chamber 2 from the light receiving element 11b of the hand detection sensor 11. The control unit 30 then performs a control in response to signals from the hand detection sensor 8 and the hand detection sensor 11.

For example, the control unit 30 operates the blower 3 when the insertion of the hand is detected by the hand detection sensor 8, and stops operating the blower 3 when the insertion of the hand is not detected by the hand detection sensor 8. With this operation, when the hand is inserted to the detecting position 2d in the drying chamber 2, the high-pressure air stream is blown from the nozzles 7a and 7b, and when the hand is not inserted to the detecting position 2d in the drying chamber 2, the air stream is not blown from the nozzles 7a and 7b.

For example, the control unit 30 operates the illuminating unit 12 when the insertion of the hand is detected by the hand detection sensor 11, and stops operating the illuminating unit 12 when the insertion of the hand is not detected by the hand detection sensor 11. With this operation, when the hand is inserted to the detecting position 2e in the drying chamber 2, the light emitted from the illuminating unit 12 illuminates the back side of the hand (or the palm side of the hand), and when the hand is not inserted to the detecting position 2e in the drying chamber 2, the light is not emitted from the illuminating unit 12.

For example, the control unit 30 operates the illuminating unit 12 when the insertion of the hand is detected by the hand detection sensor 11, and operates the blower 3 when the insertion of the hand is detected by the hand detection sensor 8. With this operation, when the hand is inserted to the detecting position 2e in the drying chamber 2 (not inserted to the detecting position 2d), the light emitted from the illuminating unit 12 illuminates the back side of the hand (or the palm side of the hand), and when the hand is inserted to the detecting position 2d in the drying chamber 2, the high-pressure air stream is blown from the nozzles 7a and 7b.

A center axis CA of the nozzle 7b and an optical axis PA of the illuminating unit 12 intersect with each other at the proper position 2f in the drying chamber 2 where a hand is supposed to be inserted. The center axis CA of the nozzle 7b matches a flow axis of the high-pressure air stream when the high-pressure air stream blown from the nozzle 7b flows toward the inner wall surface 2a. The optical axis PA of the illuminating unit 12 matches a center axis of the light when the light emitted from the illuminating unit 12 travels toward the inner wall surface 2a. That is, the flow axis of the high-pressure air stream blown from the nozzle 7b and the center axis of the light emitted from the illuminating unit 12 intersect with each other at the proper position 2f. The proper position 2f is a position where the hand is supposed to be inserted in the drying chamber 2. For example, the proper position 2f is a potential core area (an area in which the speed of the high-pressure air stream at an outlet of the nozzle does not attenuate lower than a predetermined value) in the drying chamber 2, which is a position where the hand touches none of the inner wall surfaces 2a and 2b in the drying chamber 2 and a proper position for drying both the back side of the hand and the palm side of the hand in a well balanced manner.

Figure 2:
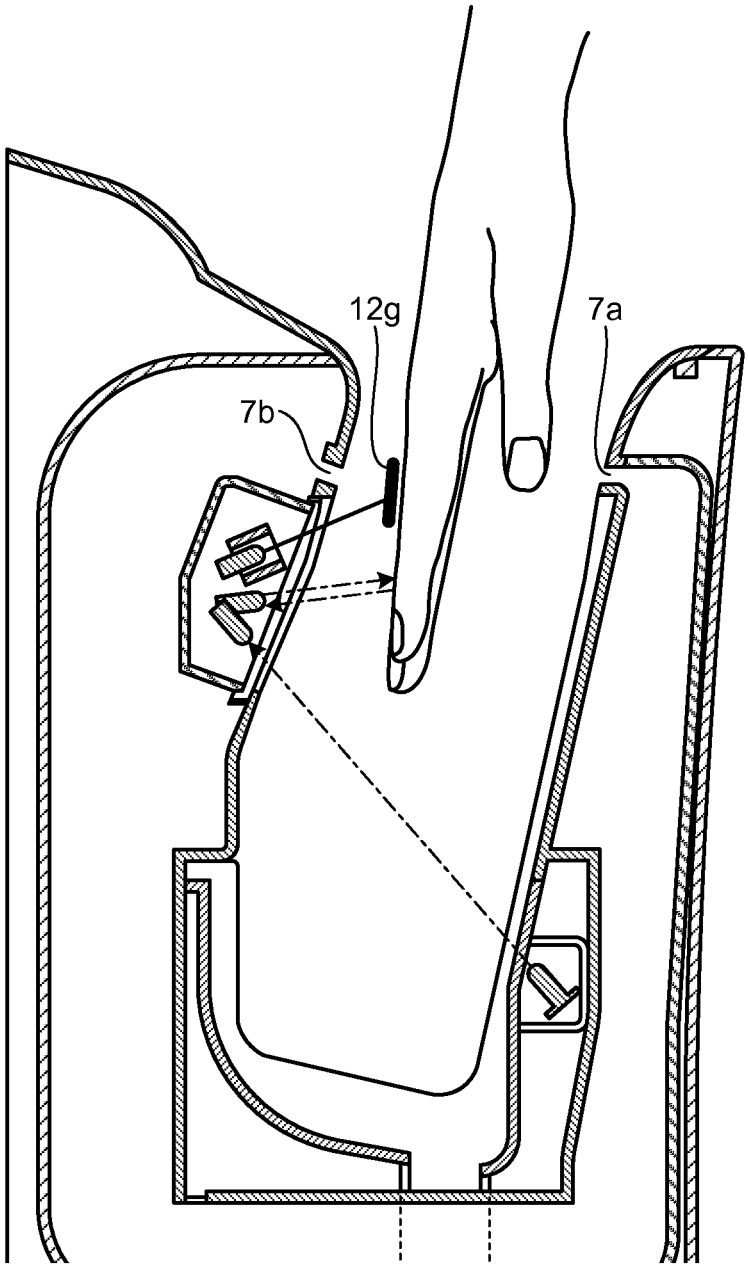
FIG. 2 depicts an operation of the hand drying device according to the first embodiment.
Figure 3:
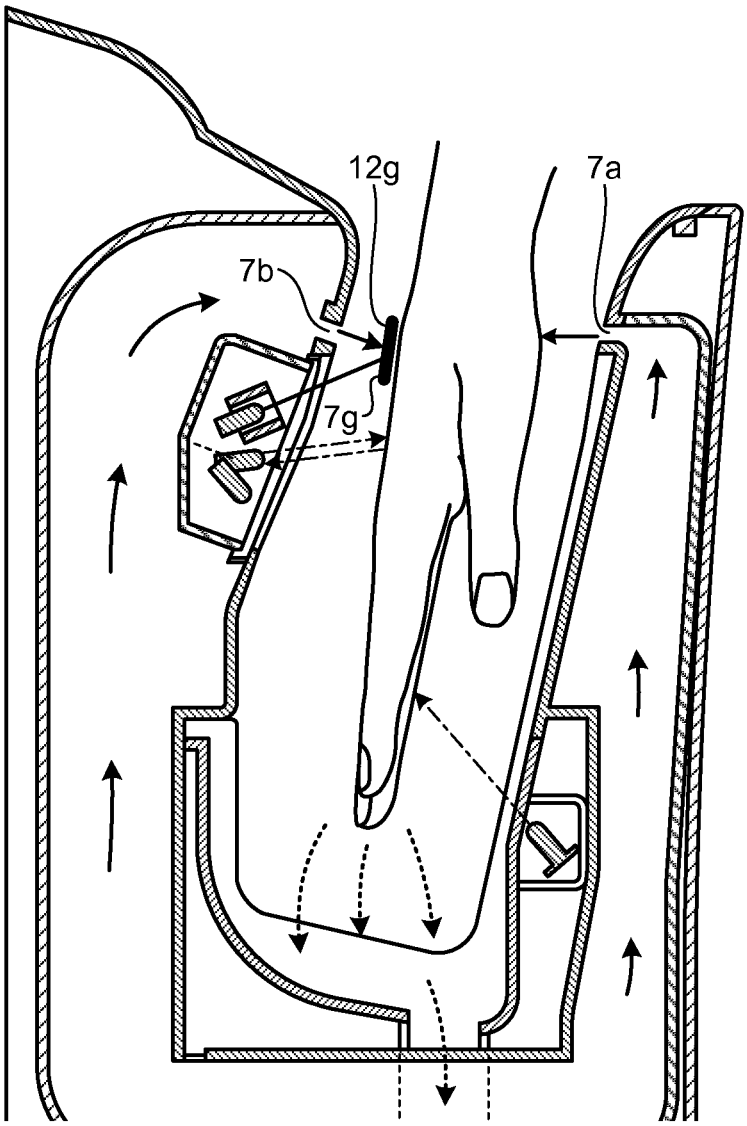
FIG. 3 depicts an operation of the hand drying device according to the first embodiment.
Figure 4:
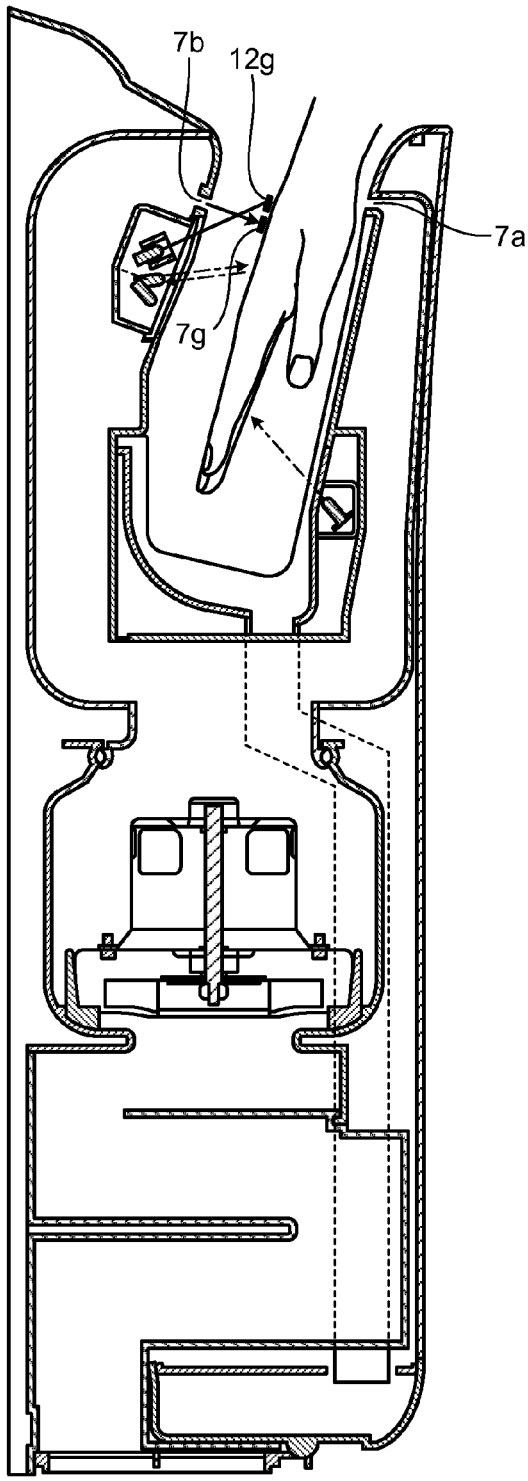
FIG. 4 depicts an operation of the hand drying device according to the first embodiment.

An operation of the hand drying device 100 will be explained next with reference to FIGS. 2 to 4. FIG. 2 depicts a state where a part of the hand is inserted into the drying chamber. FIG. 3 depicts a state where the hand is inserted to the proper position in the drying chamber. FIG. 4 depicts a state where the hand is inserted to a position other than the proper position in the drying chamber 2.

If a part of a wet hand after washing is inserted into the drying chamber 2 of the hand drying device 100, that is, if the hand is inserted to the detecting position 2e (see FIG. 2), the infrared light emitted from the light emitting element 11a of the hand detection sensor 11 (a reflection type sensor) arranged in the drying chamber 2 is reflected at the hand and returns to the light receiving element 11b. With this configuration, the amount of light received by the light receiving element 11b is changed from that of a case where the light is reflected at the inner wall surface 2a and returns to the light receiving element 11b, thereby causing the control unit 30 to determine that the hand is about to be inserted.

In response to this determination, for example, the control unit 30 turns on the illuminating unit 12 (an LED) to blink fast. The light emitted from the illuminating unit 12 is partly shielded by the light shielding unit 12b to pass through the aperture 12b1 having the opening shape equivalent to the opening shape of the nozzle 7b, further passes through the transparent cover 18, and forms an optical image 12g of the equivalent shape to the opening shape of the nozzle 7b on the back side of the hand inserted. A user can be notified of a spot where the high-pressure air stream flows can be notified by the optical image 12g, and as the optical image 12g is blinking fast, it is possible to prompt the user to insert the hand even deeper into the drying chamber 2.

The optical axis PA of the optical image 12g intersects with the center axis of the nozzle 7b at an angle. A position of the intersection is closer to the nozzle 7b from a middle position between the nozzle 7a and the nozzle 7b and apart from the inner wall surface 2b by 10 millimeters or more.

If the hand is inserted to a deeper part, that is, if the hand is inserted to the detecting position 2d (see FIGS. 3 and 4), the infrared light emitted from the light emitting element 8*a* of the hand detection sensor 8 (a transmission type sensor) arranged in the drying chamber 2 is blocked by the hand so that the light is not detected by the light receiving element 8*b*. This decreases the amount of light received by the light receiving element 8*b*, by which the control unit 30 determines that the hand is inserted to a sufficiently deeper part. In response to this determination, the control unit 30 operates the blower 3. When the blower 3 is operated, the air is taken in from the air inlet port 9*a* through the air filter 20, passes through the air inlet duct 9, and is sent to the blower 3 where the high-pressure air stream is generated.

The air passed through the blower 3 becomes the high-pressure air stream, passes through the air outlet port 14 and the air outlet ducts 15*a* and 15*b*, and blown into the drying chamber 2 from the nozzles 7*a* and 7*b*. The high-pressure air stream blown from the nozzles 7*a* and 7*b* is blown to the hand inserted into the drying chamber 2, and starts blowing the water off of the hand as the water droplet.

At this time, at a position 7*g* where the high-pressure air stream hits on a surface of the hand of the user, the surface of the hand is temporarily dented by the pressure of the high-pressure air stream, which is visually recognized. If the position 7*g* where the high-pressure air stream hits and the position of the optical image 12*g* match each other (see FIG. 3), the user can recognize that a position of the hand is at the proper position 2*f*. On the other hand, if the position 7*g* where the high-pressure air stream hits and the position of the optical image 12*g* do not match each other (see FIG. 4), the user can recognize that the position of the hand is deviated from the proper position 2*f*.

Meanwhile, upon operating the blower 3, the control unit 30 changes the fast blinking of the illuminating unit 12 (an LED) to normal lighting, and thereafter changes to a mode in which a blinking cycle is gradually shortened from slow blinking. For example, the control unit 30 controls the illuminating unit 12 such that the light is turned on for 3 seconds and turned off for 0.5 second, turned on for 2 seconds and turned off for 0.5 second, turned on for 1 second and turned off for 0.5 second, and then turning on and turning off are repeated for every 0.5 second.

Thereafter, when the hand is pulled out from the drying chamber 2, the hand detection sensor 11 (a reflection type sensor) and the hand detection sensor 8 (a transmission type sensor) detects this, by which the blower 3 is stopped and the light source 12*a* is turned off. The water droplet removed from the wet hand hits against the inner wall surfaces 2*a* and 2*b*, flows along the inner wall surfaces 2*a* and 2*b*, passes through the drain port 4 and the drain pipe 5, and collected in the drain container 10.

It is assumed a case where the illuminating unit 12 illuminates the bottom portion of the drying chamber 2. In this case, as the optical axis of the illuminating unit 12 does not intersect with the center axis of the nozzle 7*b*, the position 7*g* where the high-pressure air stream hits and the position of the optical image 12*g* do not match each other when the user uses the hand drying device 100. That is, it is difficult to realize the proper position where the hand is supposed to be inserted. This is likely to lead to a case where it is difficult to place the hand at the proper position in the drying chamber 2.

Alternatively, it is assumed a case where the illuminating unit 12 is arranged in the nozzle 7*b*. In this case, as the optical axis of the illuminating unit 12 and the center axis of the nozzle 7*b* match each other, when a user uses the hand drying device 100, the position 7*g* where the high-pressure air stream hits and the position of the optical image 12*g* match each other regardless whether the position of the hand is at the proper position. That is, it is difficult to realize the proper position where the hand is supposed to be inserted. This is likely to lead to a case where it is difficult to place the hand at the proper position in the drying chamber 2.

On the other hand, in the first embodiment, the nozzle 7*b* is arranged on the inner wall surface 2*b*, and the illuminating unit 12 is arranged at a position on the side of the inner wall surface 2*b* shifted from the nozzle 7*b* in a direction along the inner wall surface 2*b*. The center axis CA of the nozzle 7*b* and the optical axis PA of the illuminating unit 12 intersect with each other at the proper position 2*f* in the drying chamber 2 where the hand is supposed to be inserted. With this configuration, in the drying chamber 2, by a user adjusting the position of the hand appropriately such that the position 7*g* where the high-pressure air stream hits and the position of the optical image 12*g* match each other, it is possible to place the hand at the proper position 2*f* in the drying chamber 2.

That is, it is possible to place the hand at the proper position 2*f* in the drying chamber 2 with ease. As a result, it is possible to reduce an occurrence of mistakenly touching the inner wall surfaces 2*a* and 2*b* in the drying chamber 2 by the hand, and at the same time, it is possible to guide the inserted hand to a position suitable for drying the hand efficiently.

Particularly, the center axis CA of the nozzle 7*b* and the optical axis PA of the illuminating unit 12 intersect with each other at a position apart from the inner wall surface 2*b* of the drying chamber 2 by 10 millimeters or more. With this configuration, it is possible to reduce the occurrence of touching the inner wall surfaces 2*a* and 2*b* by the hand without fail.

Furthermore, the center axis CA of the nozzle 7*b* and the optical axis PA of the illuminating unit 12 intersect with each other at a position closer to the nozzle 7*b* than the middle position between the nozzle 7*a* and the nozzle 7*b*. With this configuration, it is possible to make a distance from the nozzle 7*b* to the hand and a distance from the nozzle 7*a* to the hand equal, considering a thickness of the hand. As a result, as the high-pressure air stream blown from the nozzles 7*a* and 7*b* can be equivalently blown to the back side and the palm side of the hand, it is possible to dry the back side and the palm side of the hand in a well balanced manner, thus shortening a time for drying the hand and reducing a scattering of the water from the hand.

Further, in the illuminating unit 12, the light shielding unit 12*b* shields an area around the aperture 12*b*1 that guides the light from the light source 12*a* to the proper position. With this configuration, even when the directivity of the light source 12*a* (an LED) is relatively broad, a clear optical image can be formed on the surface of the hand by using the light shielding unit 12*b*. Further, by having the opening shape of the aperture 12*b*1 of the light shielding unit 12*b* correspond to the opening shape of the nozzle 7*b*, the user can appropriately adjust the position of the hand with ease such that the position 7*g* where the high-pressure air stream hits and the position of the optical image 12*g* match each other.

Alternatively, it is assumed a case where the illuminating unit 12 is arranged in the air outlet duct 15*a* or in the nozzle 7*b* to match the optical axis of the illuminating unit 12 with the center axis of the nozzle 7*b*. In this case, a dust may be attached to the light source, which is an electronic component, causing a failure of the light source, air leakage may happen from a portion for leading a lead line for supplying an electricity into the high pressure duct, or an electric shock may occur due to water penetrated from the nozzle. When the illuminating unit 12 is arranged in the nozzle 7*b*, the drying performance is likely to be degraded as a part of the high-pressure air stream blown to the hand is lost. If an additional mechanism is provided to cope with such problems, the configuration becomes complicated, increasing the manufacturing cost of the hand drying device.

Alternatively, it is assumed a case where the illuminating unit 12 is arranged outside the air outlet ducts 15*a* and 15*b* to match the optical axis of the illuminating unit 12 with the center axis of the nozzle 7*b*. In this case, as it is necessary to form a part of the air outlet ducts 15*a* and 15*b* to guide the light from the illuminating unit 12 arranged outside the air outlet ducts 15*a* and 15*b* to the nozzle 7*b* by passing the light through a transparent portion of the air outlet ducts 15*a* and 15*b*, the configuration becomes complicated, increasing the manufacturing cost of the hand drying device.

On the other hand, in the first embodiment, the light source 12*a* and the light shielding unit 12*b* of the illuminating unit 12, the light receiving element 8*b* of the hand detection sensor 8 (for example, a transmission type sensor), and the light emitting element 11*a* and the light receiving element 11*b* of the hand detection sensor 11 (for example, a reflection type sensor) are accommodated together in the recessed portion 1*a* covered by the transparent cover 18. With this configuration, the space in the recessed portion 1*a* covered by the transparent cover 18 is separated from the air outlet duct 15*b*, which eliminates a necessity of providing a measure to prevent leakage of the high pressure air and simplifies the structure for accommodating the light source 12*a*, the light shielding unit 12*b*, the light receiving element 8*b*, the light emitting element 11*a*, and the light receiving element 11*b*. Therefore, it is possible to reduce the manufacturing cost of the hand drying device.

In the first embodiment, the control unit 30 operates the illuminating unit 12 when insertion of the hand is detected by the hand detection sensor 11, and stops operating the illuminating unit 12 when the insertion of the hand is not detected by the hand detection sensor 11. Whit this configuration, as a control can be performed not to emit the light at a time other than the time of drying the hand, it is possible to reduce the power consumption of the hand drying device.

The control unit 30 operates the illuminating unit 12 when the insertion of the hand is detected by the hand detection sensor 11, and operates the blower 3 when the insertion of the hand is detected by the hand detection sensor 8. With this configuration, an expected position where the high-pressure air stream is to be blown on the back side of the hand can be notified to a user when a hand is inserted to the detecting position 2*e* in the drying chamber 2 (not inserted to the detecting position 2*d*), and the high-pressure air stream can be actually blown to the back side of the hand when the hand is inserted to the detecting position 2*d* in the drying chamber 2.

In the first embodiment, the illuminating unit 12 emits the blinking light while gradually reducing the blinking cycle during the period from a timing when emitting the light is started to a timing when emitting the light is to be stopped. This can prompt the user to slowly pull out the hand, and can prompt the user not to continuously use the hand drying device for a long time by blinking fast. That is, the user can slowly pull out the hand according to a guidance of the blinking of the optical image 12*g*, without agitating the hand in the high-speed air blow, and as a result, it is possible to reduce an amount of scattering the water droplet to the outside of the main unit box 1.

Furthermore, as indicated by the wavy line in FIG. 1, the center line of the light emitted from the light source 12*a* (for example, an LED), that is, the optical axis of the illuminating unit 12 intersects with the inner wall surface 2*a*. With this configuration, as the light emitted from the illuminating unit 12 is shielded by the inner wall surface 2*a*, damage on the eye due to a direct visual contact with the light source 12*a* from the outside of the drying chamber 2 can be suppressed.

Although the illuminating unit 12 is arranged at a position farther from the opening 2*c* than the nozzle 7*b* on the inner wall surface 2*b*, the illuminating unit 12 may be arranged closer to the opening 2*c* than the nozzle 7*b* so long as the center axis of the nozzle 7*b* and the optical axis of the illuminating unit 12 intersect with each other at the proper position 2*f* in the drying chamber 2.

The opening shape of the aperture 12*b*1 of the light shielding unit 12*b* may be a rod shape regardless of the opening shape of the nozzle 7*b*. For example, even when the nozzle 7*b* is formed in a circular hole shape, the opening shape of the aperture 12*b*1 of the light shielding unit 12*b* may be formed in a rod shape. In this case, it is easy to form a clear optical image 12*g* on the surface of the hand. In addition, even when the nozzle 7*b* is formed in the circular hole shape, if the nozzle 7*b* is formed of a nozzle group in which a plurality of holes is arranged in a column shape, the opening shape of the aperture 12*b*1 of the light shielding unit 12*b* can be regarded to be equivalent to the whole nozzle group.

Further, when the power consumption at a standby time for which drying the hand is not performed does not matter, the light source 12*a* (an LED) of the illuminating unit 12 may be constantly turned on to emit the light toward the inner wall surface 2*a*. In this case, the drying chamber 2 is brightly illuminated in the vicinity of the opening 2*c* before the hand is inserted, the user can insert the hand in the drying chamber 2 with ease.

The control unit 30 can perform a control such that continuous light is emitted during a period from a timing when emitting the light is started to a timing when a threshold time elapses, and blinking light is emitted during a period from a timing when the threshold time elapses to a timing when emitting the light is to be stopped. This can notify the user of the threshold time, that is, a fact that a recommended dry time is elapsed, prompting the user to pull out the hand.

Furthermore, when it is not bright enough only with the light source 12*a* (an LED) of the illuminating unit 12, a lighting unit (a lighting LED) for lighting up inside the drying chamber 2 may be further arranged. That is, this lighting unit lights up a broad area in the drying chamber 2 with light having a low directivity as compared to the illuminating unit 12. With this arrangement, it is possible to illuminate a broad range on the back side of the hand while maintaining a state of being able to visually recognize the optical image 12*g*.

Figure 5:
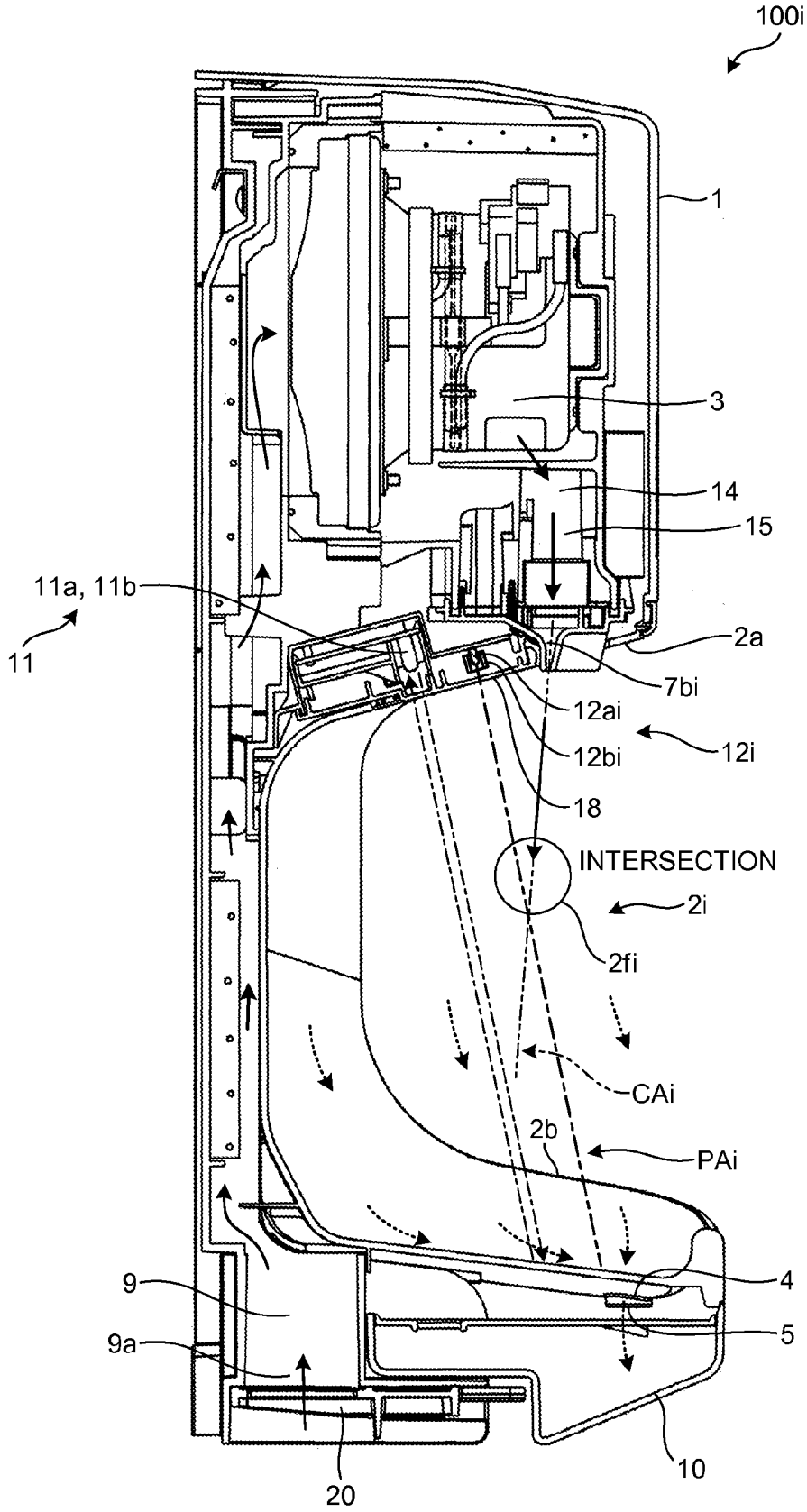
FIG. 5 depicts a configuration of a hand drying device according to a modification of the first embodiment.

As illustrated in FIG. 5, in a hand drying device 100*i*, a drying chamber 2*i* may be a space formed by a portion of a C-shaped wall in the main unit box 1. Also in the hand drying device 100*i*, a center axis CAi of a nozzle 7*bi* and an optical axis PAi of an illuminating unit 12*i* intersect with each other at a proper position 2*fi* in the drying chamber 2*i* where the hand is supposed to be inserted. That is, a flow axis of the high-pressure air stream blown from the nozzle 7*bi* and a center axis of light guided from a light source 12*ai* via a light shielding unit 12*bi* intersect with each other at the proper position 2*fi*. Therefore, also with the hand drying device 100*i*, it is possible to place the hand at the proper position 2*fi* in the drying chamber 2*i* with ease.

Second Embodiment

Figure 6:
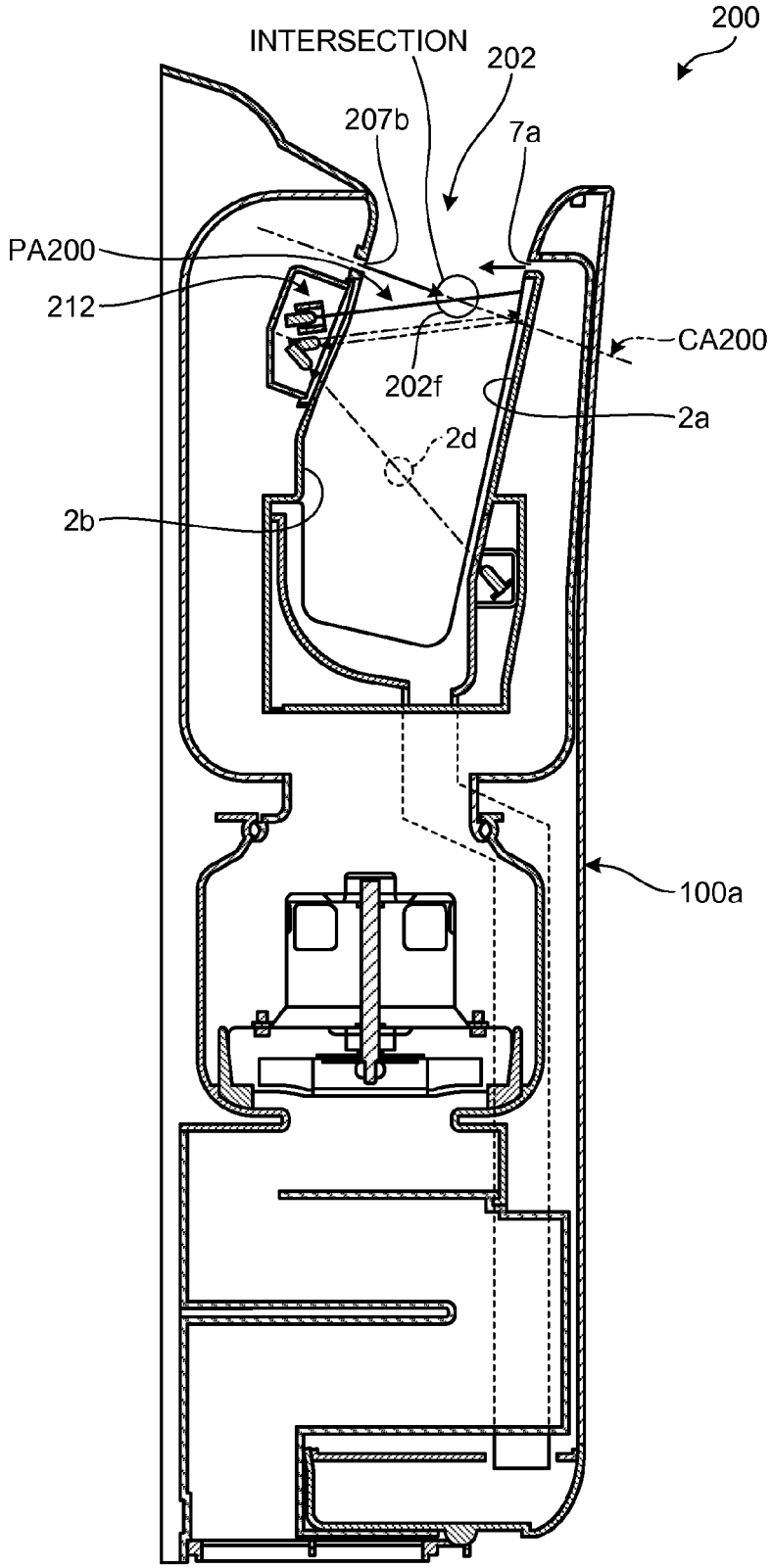
FIG. 6 depicts a configuration of a hand drying device according to a second embodiment.

A hand drying device 200 according to a second embodiment is explained with reference to FIG. 6. FIG. 6 is a cross-sectional view of the hand drying device 200 according to the second embodiment cut in a direction parallel to the vertical direction and perpendicular to a front surface 100*a*. In the following descriptions, elements different from those of the first embodiment are mainly explained.

The hand drying device 200 includes a nozzle 207*b* and an illuminating unit 212. A center axis CA200 of the nozzle 207*b* and an optical axis PA200 of the illuminating unit 212 intersect with each other at a position (a proper position 202*f*) that is closer to the nozzle 7*a* than a middle position between the nozzle 207*b* and the nozzle 7*a* and apart from the inner wall surface 2*a* by 10 millimeters or more.

In the second embodiment, as the inserted hand can be guided to a position (the proper position 202*f*) that is closer to the nozzle 7*a* so that the high-pressure air stream blown from the nozzle 7*a* can be blown to the palm side of the hand more strongly, thus it is possible to dry the palm side of the hand intensively. That is, as the palm side of the hand is closer to the nozzle, it is possible to dry the palm side of the hand more intensively, on which the water droplet is likely to be remained.

Third Embodiment

Figure 7:
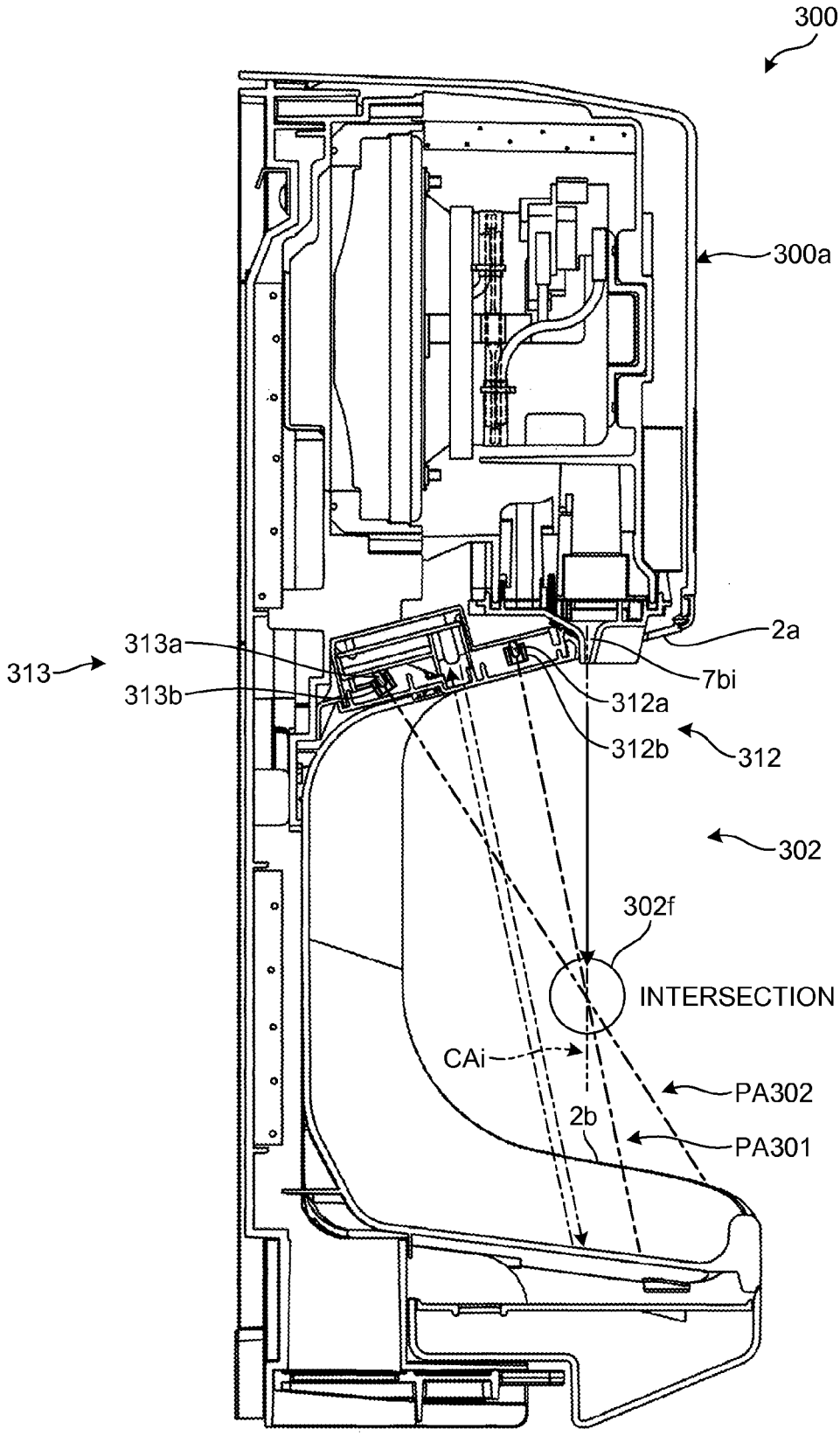
FIG. 7 depicts a configuration of a hand drying device according to a third embodiment.

A hand drying device 300 according to a third embodiment is explained with reference to FIG. 7. FIG. 7 is a cross-sectional view of the hand drying device 300 according to the third embodiment cut in a direction parallel to the vertical direction and perpendicular to a front surface 300*a*. In the following descriptions, elements different from those of the modification of the first embodiment shown in FIG. 5 are mainly explained.

The hand drying device 300 includes an illuminating unit (first illuminating unit) 312 and an illuminating unit (second illuminating unit) 313. The illuminating unit 312 is arranged at a position on a side of the inner wall surface 2*a* shifted from the nozzle 7*bi* in a direction along the inner wall surface 2*a*, and emits light toward the inner wall surface 2*b*. The illuminating unit 313 is arranged at a position on a side of the inner wall surface 2*a* shifted from the nozzle 7*bi* and the illuminating unit 312 in the direction along the inner wall surface 2*a*, and emits light toward the inner wall surface 2*b*. An optical axis PA301 of the illuminating unit 312 and an optical axis PA302 of the illuminating unit 313 intersect with each other at a proper position 302*f* in a drying chamber 302 where a hand is supposed to be inserted. The optical axis PA301 of the illuminating unit 312 and the optical axis PA302 of the illuminating unit 313 intersect with each other at a position apart from the inner wall surfaces 2*a* and 2*b* of the drying chamber 302 by 10 millimeters or more. The illuminating unit 312 and the illuminating unit 313 have the same internal configuration, including light sources 312*a* and 313*a* and light shielding units 312*b* and 313*b* that shield areas around holes for guiding light from the light sources 312*a* and 313*a* to the proper position 302*f*, respectively.

In the third embodiment, when the hand is inserted into the drying chamber 302, a user can recognize that a position of the hand is at the proper position 302*f* if a position of an optical image formed by the illuminating unit 312 and a position of an optical image formed by the illuminating unit 313 match each other. On the other hand, if the position of the optical image formed by the illuminating unit 312 and the position of the optical image formed by the illuminating unit 313 do not match each other, the user can recognize that the position of the hand is deviated from the proper position 302*f*. In this manner, in the drying chamber 302, by the user adjusting the position of the hand appropriately such that the position of the optical image formed by the illuminating unit 312 and the position of the optical image formed by the illuminating unit 313 match each other, it is possible to place the hand at the proper position 302*f* in the drying chamber 302. That is, it is possible to place the hand at the proper position 302*f* in the drying chamber 302 with ease. As a result, it is possible to reduce an occurrence of mistakenly touching the inner wall surfaces 2*a* and 2*b* in the drying chamber 302 by the hand, and at the same time, it is possible to guide the inserted hand to a position suitable for drying the hand in an efficient manner.

Although a case where a center axis CAi of the nozzle 7*bi* intersect at an intersection position where the optical axis PA301 of the illuminating unit 312 and the optical axis PA302 of the illuminating unit 313 intersect with each other is described as an example in FIG. 7, as it suffices if the optical axis PA301 of the illuminating unit 312 and the optical axis PA302 of the illuminating unit 313 intersect with each other, the center axis CAi of the nozzle 7*bi* is not necessarily to intersect with the optical axis PA301 of the illuminating unit 312 and the optical axis PA302 of the illuminating unit 313 at the same point.

INDUSTRIAL APPLICABILITY

As described above, the hand drying device according to the present invention is useful for a hand drying device installed in a toilet or a powder room that can be used by people of the general public and installed in places such as office buildings, hotels, family restaurants, amusement facilities, complex super markets, factories of foods, medicines, cosmetics, and other products, schools, and public facilities.

REFERENCE SIGNS LIST

1 main unit box
2, 2*i*, 202, 302 drying chamber
2*a* inner wall surface
2*b* inner wall surface
2*c* opening
2*d* detecting position
2*e* detecting position
2*f*, 2*fi*, 202*f*, 302*f* proper position
3 blower
4 drain port
5 drain pipe
7*a* nozzle
7*b*, 7*bi*, 207*b* nozzle
7*g* position where high-pressure air stream hits
8 hand detection sensor
8*a* light emitting element
8*b* light receiving element
9 air inlet duct
9*a* air inlet port
10 drain container
11 hand detection sensor
11*a* light emitting element
11*b* light receiving element
12, 12*i*, 212, 312 illuminating unit
12*a*, 12*ai*, 312*a* light source
12*b*, 12*bi*, 312*b* light shielding unit
12*g* optical image
14 air outlet port
15*a*, 15*b* air outlet duct
18 transparent cover
20 air filter
30 control unit
100, 100*i*, 200, 300 hand drying device
100*a*, 300*a* front surface
100*b* rear surface
100*c* bottom surface
313 illuminating unit
313*a* light source
313*b* light shielding unit CA, CA1, CA200 center axis
PA, PA1, PA200, PA301, PA302 optical axis

The invention claimed is:

1. A hand drying device comprising:

a drying chamber that includes an opening, a first inner wall surface, and a second inner wall surface facing the first inner wall surface, where a hand is inserted from the opening into a space between the first inner wall surface and the second inner wall surface;

a nozzle that is arranged on the first inner wall surface and is configured to blow an air stream toward the second inner wall surface;

a supply unit that supplies an air stream to the nozzle;

a hand detection sensor that detects insertion of a hand into the drying chamber;

a control unit that operates the supply unit when insertion of a hand is detected by the hand detection sensor and stops operating the supply unit when insertion of a hand is not detected by the hand detection sensor; and an illuminating unit that is arranged at a position on the first inner wall surface shifted from the nozzle in a direction along the first inner wall surface and is configured to emit light toward the second inner wall surface, wherein a center axis of the nozzle and an optical axis of the illuminating unit intersect with each other at a proper position in the drying chamber where a hand is supposed to be inserted, wherein on the hand inserted to the drying chamber, the hand drying device is configured to notify the user that the hand is at the proper position when a position of an optical image formed by a light emitted from the illuminating unit and a position where the high-pressure air stream hits on a surface of the hand mach.

2. The hand drying device according to claim 1, wherein the center axis of the nozzle and the optical axis of the illuminating unit intersect with each other at a position separated from the first inner wall surface by 10 millimeters or more.

3. The hand drying device according to claim 2, further comprising a second nozzle that is arranged on the second inner wall surface and is configured to blow an air stream toward the first inner wall surface, wherein the center axis of the nozzle and the optical axis of the illuminating unit intersect with each other at a position on a side closer to the nozzle than a middle position between the nozzle and the second nozzle.

4. The hand drying device according to claim 2, further comprising a second nozzle that is arranged on the second inner wall surface and is configured to blow an air stream toward the first inner wall surface, wherein the center axis of the nozzle and the optical axis of the illuminating unit intersect with each other at a position on a side closer to the second nozzle from a middle position between the nozzle and the second nozzle.

5. The hand drying device according to claim 1, wherein the illuminating unit includes a light source, and a light shielding unit that includes an aperture for guiding light from the light source to the proper position and shields an area around the aperture.

6. The hand drying device according to claim 5, wherein an opening shape of the aperture of the light shielding unit is a shape corresponding to an opening shape of the nozzle.

7. The hand drying device according to claim 5, wherein an opening shape of the aperture of the light shielding unit is a rod shape.

8. The hand drying device according to claim 1, further comprising:

a main unit that forms a part of the first inner wall surface and the second inner wall surface and includes a recessed portion that is recessed from the first inner wall surface on a side of the first inner wall surface; and a transparent cover that covers the recessed portion to form a rest part of the first inner wall surface on the recessed portion, wherein the hand detection sensor includes a light emitting unit and a light receiving unit that receives light from the light emitting unit and is configured to detect insertion of a hand into the drying chamber according to an amount of light received by the light receiving unit, and the illuminating unit and at least the light emitting unit of the hand detection sensor are accommodated together in the recessed portion covered by the transparent cover.

9. The hand drying device according to claim 1, wherein the illuminating unit constantly emits light toward the second inner wall surface.

10. The hand drying device according to claim 1, wherein the control unit operates the illuminating unit when insertion of a hand is detected by the hand detection sensor and stops operating the illuminating unit when insertion of a hand is not detected by the hand detection sensor.

11. The hand drying device according to claim 1, further comprising a second hand detection sensor that detects insertion of a hand at a position closer to the opening than a detection position of the hand detection sensor in the drying chamber, wherein the control unit operates the illuminating unit when insertion of a hand is detected by the second hand detection sensor and operates the supply unit when insertion of a hand is detected by the hand detection sensor.

12. The hand drying device according to claim 1, wherein the illuminating unit emits continuous light during a period from a timing when the illuminating unit starts illuminating light to a timing when a threshold time elapses, and emits blinking light during a period from the timing when the threshold time elapses to a timing when the illuminating unit stops illuminating the light.

13. The hand drying device according to claim 1, wherein the illuminating unit emits blinking light during a period from a timing when the illuminating unit starts illuminating light to a timing when the illuminating unit stops illuminating the light while gradually decreasing a blinking cycle.

14. The hand drying device according to claim 1, wherein the optical axis of the illuminating unit intersects with the second inner wall surface such that light emitted from the illuminating unit is shielded by the second inner wall surface.

15. The hand drying device according to claim 1, further comprising a lighting unit that lights up the drying chamber.

16. A hand drying device comprising:

a drying chamber that includes an opening, a first inner wall surface, and a second inner wall surface facing the first inner wall surface, where a hand is inserted from the opening into a space between the first inner wall surface and the second inner wall surface;

a nozzle that is arranged on the first inner wall surface and is configured to blow an air stream toward the second inner wall surface;

a supply unit that supplies an air stream to the nozzle;

a hand detection sensor that detects insertion of a hand into the drying chamber;

a control unit that operates the supply unit when insertion of a hand is detected by the hand detection sensor and stops operating the supply unit when insertion of a hand is not detected by the hand detection sensor;

a first illuminating unit arranged at a position on the first inner wall surface shifted from the nozzle in a direction along the first inner wall surface and configured to output light toward the second inner wall surface, and a second illuminating unit that is arranged at a position on the first inner wall surface shifted from the nozzle and the first illuminating unit in a direction along the first inner wall surface and is configured to emit light toward the second inner wall surface, wherein an optical axis of the first illuminating unit and an optical axis of the second illuminating unit intersect with each other at a proper position in the drying chamber where a hand is supposed to be inserted.

* * * * *